US005293667A

United States Patent [19]

Kitamura

[11] Patent Number: 5,293,667

[45] Date of Patent: Mar. 15, 1994

[54] CLEARER DEVICE FOR DRAFT ROLLER

[76] Inventor: Yoji Kitamura, 1-18, Deguchi 1-chome, Hirakata-shi, Osaka-fu, Japan

[21] Appl. No.: 909,789

[22] Filed: Jul. 7, 1992

[30] Foreign Application Priority Data

Jul. 5, 1991 [JP] Japan ..... 3-60659
Feb. 28, 1992 [JP] Japan ..... 4-79156

[51] Int. Cl.[5] ..... D01H 5/62
[52] U.S. Cl. ..... 19/262; 19/264
[58] Field of Search ..... 19/262, 263, 264, 265; 57/97; 15/256.5, 256.51, 256.52, 256.53, 256.6

[56] References Cited

U.S. PATENT DOCUMENTS

| | | | |
|---|---|---|---|
| 1,451,990 | 8/1923 | Chapelle | 19/264 |
| 2,948,023 | 8/1960 | Bonalumi | 19/264 |
| 3,340,577 | 9/1967 | Morrow et al. | 19/265 |
| 3,531,832 | 10/1970 | Whitehead et al. | 19/265 |
| 4,590,647 | 5/1986 | Fahmüller | 19/265 |
| 4,785,507 | 11/1988 | Miyazaki | 19/262 |
| 4,819,302 | 4/1989 | Fukuda et al. | 19/262 |

FOREIGN PATENT DOCUMENTS

| | | | |
|---|---|---|---|
| 339545 | 8/1959 | Fed. Rep. of Germany . | |
| 3807985 | 10/1988 | Fed. Rep. of Germany . | |
| 3929490 | 3/1991 | Fed. Rep. of Germany | 19/264 |
| 63-24279 | 2/1988 | Japan . | |
| 63-35831 | 2/1988 | Japan . | |
| 1-104837 | 4/1989 | Japan . | |
| 1-104838 | 4/1989 | Japan . | |
| 1980 | of 1910 | United Kingdom | 19/264 |
| 286 | of 1913 | United Kingdom | 19/264 |

*Primary Examiner*—Clifford D. Crowder
*Assistant Examiner*—Larry D. Worrell, Jr.
*Attorney, Agent, or Firm*—Thomas R. Morrison

[57] ABSTRACT

A clearer device for removing accumulated debris on a draft roller has a clearer pad member mounted in a support frame which pivots so as to permit the clearer pad member to come into and out of contact with the draft roller thereby allowing accumulated wastes to escape. A stopper plate is biased against the draft roller by the clearer pad member thus keeping the clearer pad member in contact with the draft roller. An elastic member protrudes from the support frame and contacts a rotating shaft which has a protrusion. The protrusion periodically engages the elastic member which pivots the support frame disengaging the clearer pad member from the draft roller and releasing accumulated wastes.

4 Claims, 7 Drawing Sheets

CLEARER DEVICE FOR DRAFT ROLLER

BACKGROUND ART

This invention relates to a clearer apparatus applied to a draft roller for use as a drafting apparatus for a spinning machine equipment, and more particularly to a clearer apparatus which consists of a clearer in the form of a plate which can remove cotton waste or the like on a draft roller with certainty using a clearer pad member formed from rubber, a synthetic resin material or the like.

A clearer apparatus for a bottom draft roller of a drafting apparatus is already known wherein a clearer pad member comprising of leather, artificial leather, natural rubber, synthetic rubber, laminated non-woven fabric or the like which is cut into a fragment is used and held on a support frame in the form of a plate formed with a length substantially equal to a length between roller stands such that a portion of the clearer pad member is projected outwardly from the support frame until the outwardly projected portion contacts with a peripheral face of a drafting portion of a draft roller. Also the applicant of the present patent application has proposed a clearer of the pad type and a supporting apparatus for a clearer of such construction in Japanese Patent Laid-Open Application No. Sho 63-35831 and Japanese Utility Model Laid-Open Application No. Sho 63-24279.

While it is known that such a clearer of the pad type as described above can exhibit a superior cleaning effect comparing with a conventional clearer of the rotary type, the clearer of the pad type has a problem that, after continuous use for a long period of time, cotton waste and so forth will accumulate on a projected portion of the clearer pad member or the like.

In order to prevent such accumulation, various solutions have been proposed including means wherein a support frame or the like is rocked to change the orientation angle of the same and another means wherein the position at which the projected portion of the clearer pad member contacts is moved in a circumferential direction of the draft roller. However, the solution which only involves a change of the angular orientation of the support frame or involves a movement of the contacting position of the projected portion of the clearer pad member cannot remove accumulated substance actively from the draft roller and consequently cannot achieve sufficient removal of accumulated substance.

In addition, the solution which involves a change of the angular orientation of the support frame has another problem that the mounting structure for the support frame and so forth become complicated and the operation for maintenance and so forth are troublesome.

OBJECT OF THE INVENTION

The present invention has been made to solve the problems described above and provides a clearer apparatus which can remove cotton waste and so forth accumulated on a support frame, a clearer pad member and so forth with certainty while the mounting structure thereof at a position opposing to a draft roller is simple.

DETAILED DESCRIPTION OF THE INVENTION

Figure 1:
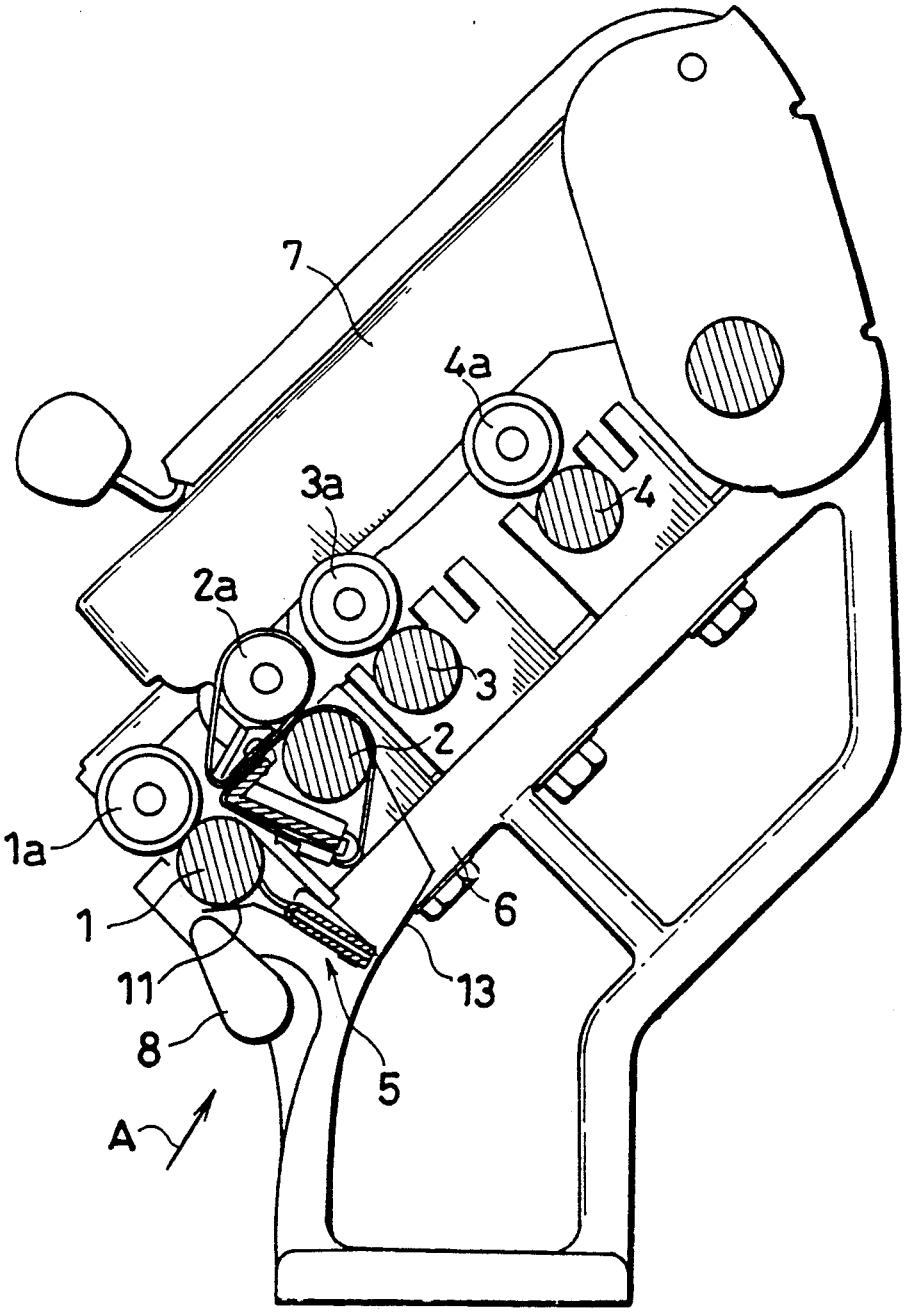
FIG. 1 is a schematic side elevational view showing a preferred embodiment of the present invention.

FIG. 1 is a partially cutaway side elevational view showing a preferred embodiment of the present invention which is applied to a front bottom roller 1, and generally shows a drafting apparatus for a ring fine spinning frame. The drafting apparatus includes a pair of front rollers 1 and 1*a*, a pair of apron rollers 2 and 2*a*, a pair of third rollers 3 and 3*a*, and a pair of back rollers 4 and 4*a*. The top rollers 1*a*, 2*a*, 3*a* and 4*a* of the drafting apparatus are supported for rotation on a weighting arm 7 and disposed so as to be pressed against the bottom rollers 1, 2, 3 and 4, respectively. Meanwhile, the bottom rollers 1, 2, 3 and 4 are supported for rotation on a roller stand 6. A plurality of drafting sections are formed corresponding to spinning portions of spindles (normally 4 to 8 spindles) in a stuff between each pair of such roller stands 6 (for example, a flute section (see FIG. 3) as a drafting portion is formed for the front bottom roller 1).

Figure 2:
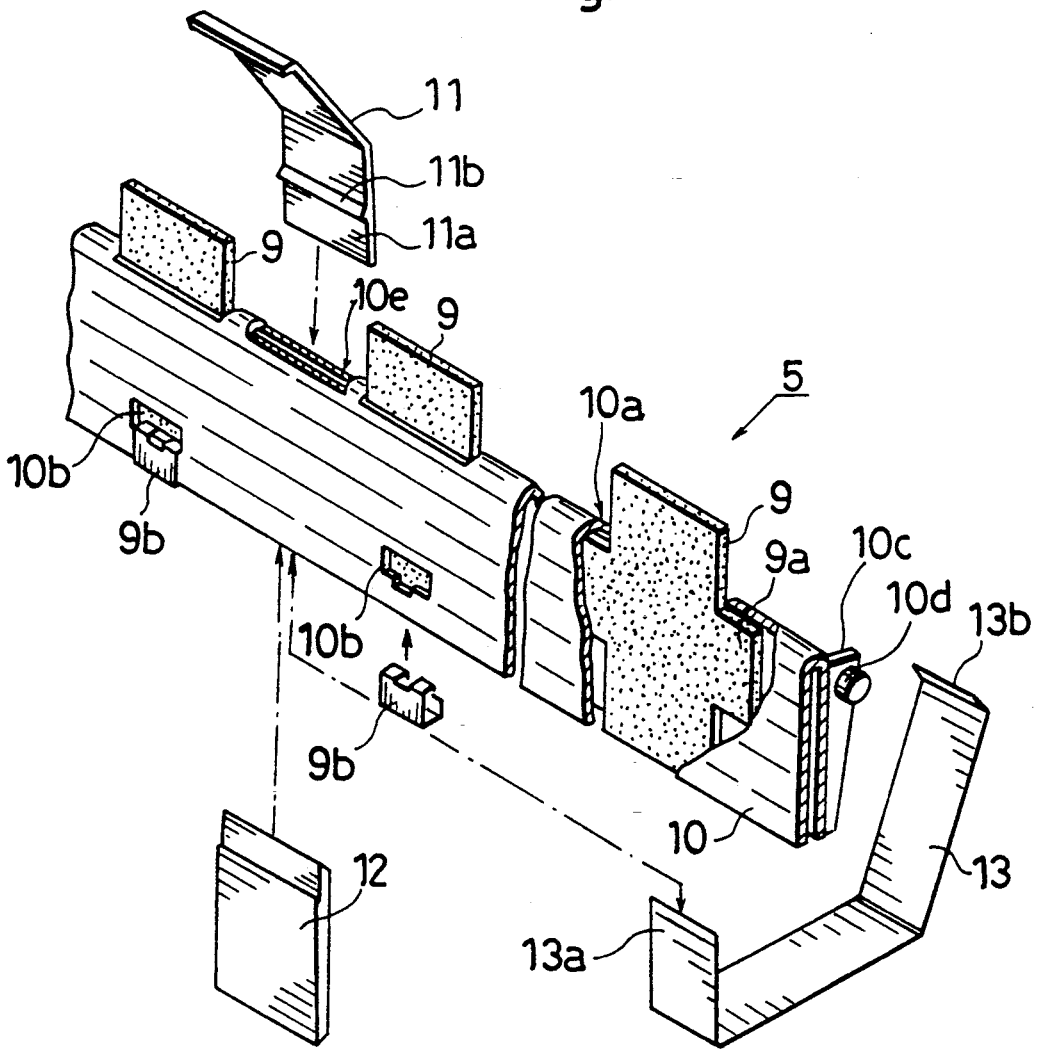
FIG. 2 is a partial schematic perspective and partial cutaway view, of the clearer apparatus shown in FIG. 1.

Such a clearer 5 in the form of a plate as shown in FIG. 2 is disposed in parallel to a longitudinal direction of the front bottom roller 1. The plate-formed clearer 5 consists of a support frame 10 having a U-shaped cross section and a plurality of clearer pad members 9 inserted in the support frame 10. Each of the clearer pad members 9 has a generally cross-shaped configuration and is projected outwardly from a corresponding one of window holes 10*a* formed in the support frame 10. The projected portion of the clearer pad member 9 is restricted in projected length such that a pair of stopper portions 9*a* thereof each in the form of a tongue contacts with a folded portion of the support frame 10. A plurality of arresting holes 10*b* are formed at side portions of a rear portion of the support frame 10, and a resilient stopper 9*b* formed from a leaf spring is fitted in each of the arresting holes 10*b* and fixedly grasps the corresponding pad member 9. Meanwhile, a pair of projecting members 10*c* (only one is shown in the Figures) is provided at the opposite ends of the support frame 10 which constitutes the plate-formed clearer described above. Support shafts 10*d* serving as a pivotally supporting member are disposed on each of the projecting members 10*c* and extend in parallel to the axes of the draft rollers. It is to be noted that the support shafts 10*d* are preferably provided on the portions of the projecting members 10*c* adjacent the projected portions of the pad members 9 such that, when the entire clearer member 5 is supported at the support shafts 10*d* at the opposite ends of the support frame 10, the projected portions of the pad members 9 may be inclined upwardly so that engagement thereof with the draft roller which will be described hereinafter may be performed rapidly. In addition, it is recommended that collars made of synthetic resin for assuring an enhanced slipping property be fitted on the support shafts 10*d*.

Figure 3:
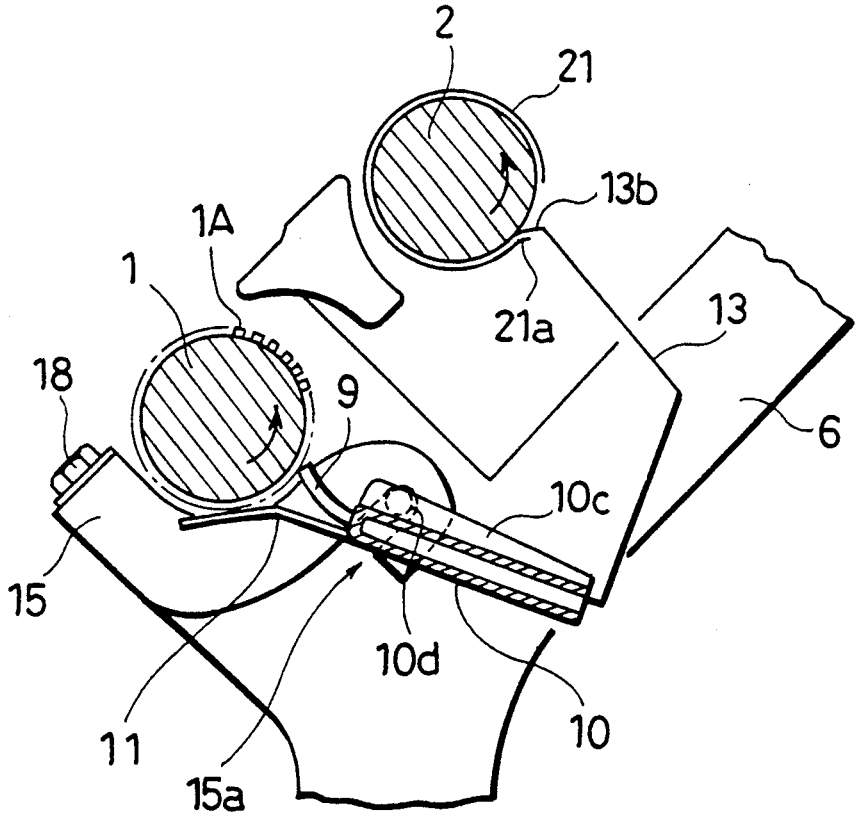
FIG. 3 is a schematic view showing a mounting condition of the clearer apparatus shown in FIG. 1.

Another window hole 10*e* separate from the window holes 10*a* for the pad members 9 is formed at a portion of the support frame 10 adjacent the projected portions of the pad members 9 (adjacent the draft roller), and a stopper 11 having a curved or bent profile is mounted in the window hole 10*e*. In particular, in the arrangement shown in FIG. 2, the stopper 11 on which an insertion restricting portion 11*b* is formed is inserted into the window hole 10*e* and then a stopping member 12 in the form of a plate is inserted from the opposite side into the support frame 10 to fix the stopper 11 to the support frame 10. The stopper 11 is formed from a synthetic resin material, a spring steel material or the like so as to restrict pivoting motion of the plate-formed clearer 5 around the common axis of the support shafts 10*d* in such a manner as seen in FIG. 3 (or FIG. 6) (which will be described hereinafter in detail). Meanwhile, when the stopping member 12 is to be inserted, preferably a channel-shaped operating resilient plate 13 is inserted into and fixed in the support frame 10 at the same time so that the operating elastic plate 13 may be fixed in a projected condition at a rear portion of the support frame 10 (opposite side of the projected portion of the pad member 9). It is to be noted that preferably an abrasion resisting member 11*c* (see FIG. 6) made of a polyimide resin or the like is mounted at an end of the stopper 11 adjacent the draft roller in order to prevent abrasion of the end of the stopper 11 by the draft roller.

Figure 8:
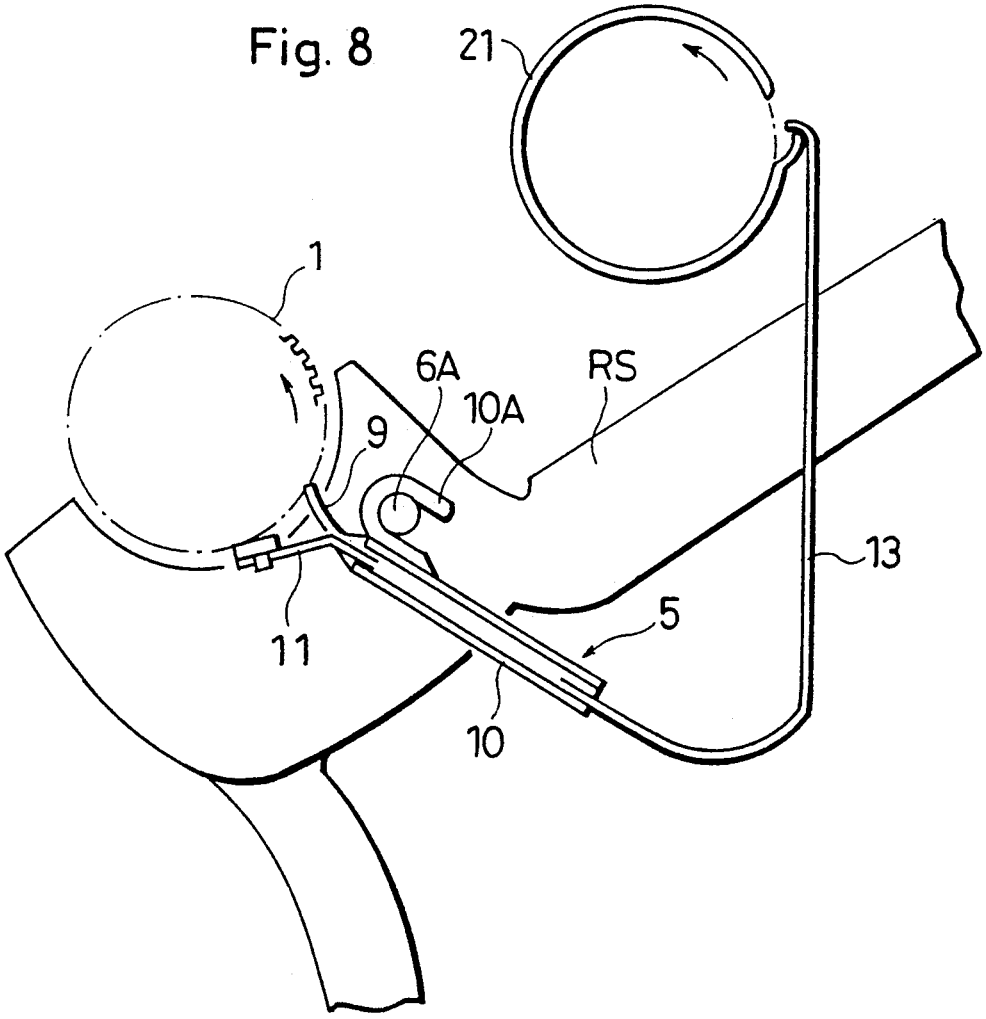
FIG. 8 is a schematic side elevational view showing a further preferred embodiment of the present invention.

In the meantime, a bracket 15 is mounted on the roller stand 6 by means of a bolt 18 as shown in FIG. 3. The bracket 15 has an elongated slot 15*a* formed therein such that it is inclined obliquely (substantially in parallel to a tangential line to the draft roller), and one of the support shafts 10*d* is fitted in the elongated slot 15*a*. The support shafts 10*d* formed on the opposite ends of the plate-formed clearer 5 are fitted in the elongated slots of the brackets 15 provided on the opposing roller stands 6, 6 to support the plate-formed clearer 5 for free pivoting motion. It is to be noted that the structure for supporting a support shaft 10*d* is not limited to such arrangement as described above, but may be such an alternative arrangement as shown in FIG. 8 wherein, as described hereinabove, the structure includes a bearing of a slot-shaped, circular or elongated hole or the like. Meanwhile, the pivotally supporting member may be of such a structure that supporting holes or slots are formed in the projecting members 10*c* at the opposite ends of the plate-formed clearer and shafts which are fitted in the holes or slots are provided on the bracket or roller stand.

Figure 4A:
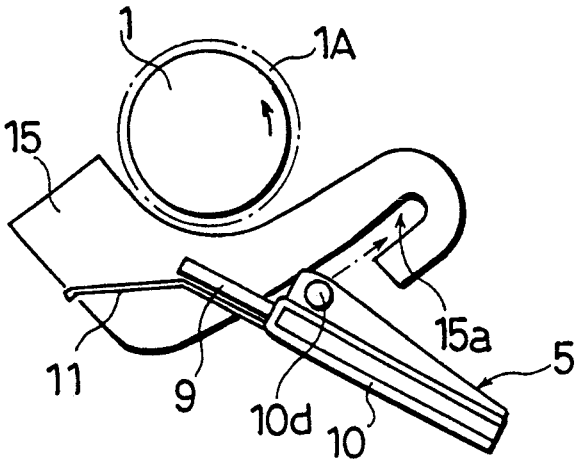
FIGS. 4A to 4C are schematic views illustrating different stages of operation of the clearer apparatus shown in FIG. 3.
Figure 4B:
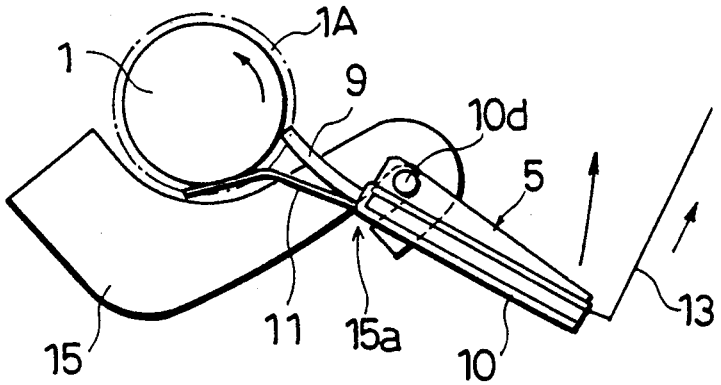
Figure 4C:
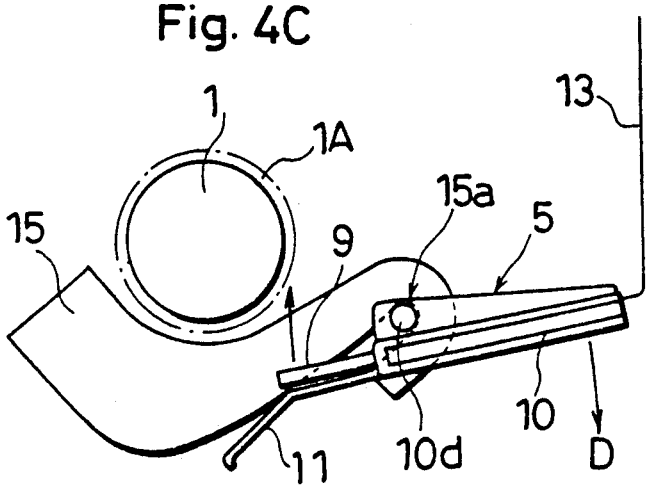

The plate-formed clearer 5 shown in FIG. 3 is assembled in the following manner and operates in such a manner as shown in FIGS. 4A, 4B and 4C. When the support shafts 10*d* are inserted into the elongated slots 15*a* as indicated by an arrow mark of a chain line in FIG. 4A, the projected portions of the pad members 9 are contacted with a peripheral face of the front bottom roller 1 which rotates in the direction indicated by an arrow mark so that a force acts upon the plate-formed clearer 5 to press the whole thereof upwardly and the stopper 11 is contacted with the draft roller 1 and held in such a stable condition as shown in FIG. 4B. At that time, the projected portions of the pads 9 are contacted in a curved condition with the peripheral face of the roller 1 so that they exhibit such a cleaning effect as to brush away cotton waste and so forth sticking to the peripheral face of the roller 1. In this condition, since the plate-formed clearer 5 is acted upon from the roller 1 by an upwardly pressing force as described above, it will not drop along the elongated slots 15*a*. Further, rearward movement of the plate-formed clearer 5 around the support shafts 10*d* is restricted by the stopper 11 contacting with the roller 1, and the pad members 9 will not be spaced away from the peripheral face of the roller 1.

By the way, a projected end 13*b* of the operating resilient plate 13 is contacted with a peripheral face of the apron roller 2 as shown in FIG. 3, and an arresting ring 21 is secured to the circumferential face of the roller 2. An arresting plate 21*a* extends from the circumferential face of the roller 2, and each time the roller 2 rotates, engagement and disengagement of the arresting piece 21*a* and the projected end 13*b* of the operating resilient plate 13 are repeated. Thus, the operating resilient plate 13 is pulled upwardly by such engagement. Accordingly, when the operating elastic plate 13 is pulled upwardly in the direction indicated by an arrow mark from the condition shown in FIG. 4B, the plate-formed cleaner 5 is pivoted around the axis of the support shafts 10*d* as shown in FIG. 4C, whereupon the projected portions of the pad members 9 are spaced away from the peripheral face of the roller 1 and are inclined downwardly so that cotton waste and so forth accumulated on the projected portions of the pad members 9 and so forth are dropped. Then, when disengagement of the operating elastic plate 13 takes place, the elastic plate 13 drops, whereupon the plate-formed clearer 5 is pivoted upwardly in the direction indicated by an arrow mark D in FIG. 4C around the axis of support shafts 10*d* to return to the condition shown in FIG. 4B. In this instance, since frictional resistance is present between the support shafts 10*d* and the elongated slots 15*a*, the plate-formed clearer 5 is pivoted before the support shafts 10*d* slip down in the elongated slots 15*a*. Then, when ends of the projected portions of the pad members 9 are contacted with the peripheral face of the roller 1 upon such pivoting motion, the entire plate-formed clearer 5 is acted upon by an upwardly pressing force by a force of rotation of the roller 1 so that it is held in a stable condition as shown in FIG. 4B. The arresting piece 21*a* is not limited to that formed on the apron roller 2 just above, but may be provided on the third bottom roller or the back bottom roller.

It is to be noted that a removing operation of the plate-formed clearer 5 may proceed such that the support frame 10 is moved, holding the opposite ends thereof by hands, in parallel downwardly along the elongated slots 15*a*, whereupon the projected portions of the pad members 9 are spaced away from the roller 1 so that the plate-formed clearer 5 can be removed readily from the bracket 15.

As described above, the plate-formed clearer 5 exhibits, in the condition shown in FIG. 4B, a cleaning effect of removing cotton waste and so forth sticking to the peripheral face of the front top roller 1 and besides can be inclined, each time the apron roller 2 is rotated, downwardly so as to drop cotton waste and so forth accumulated on the plate-formed clearer 5, thereby exhibiting a superior cleaning effect for the draft roller.

Figure 6:
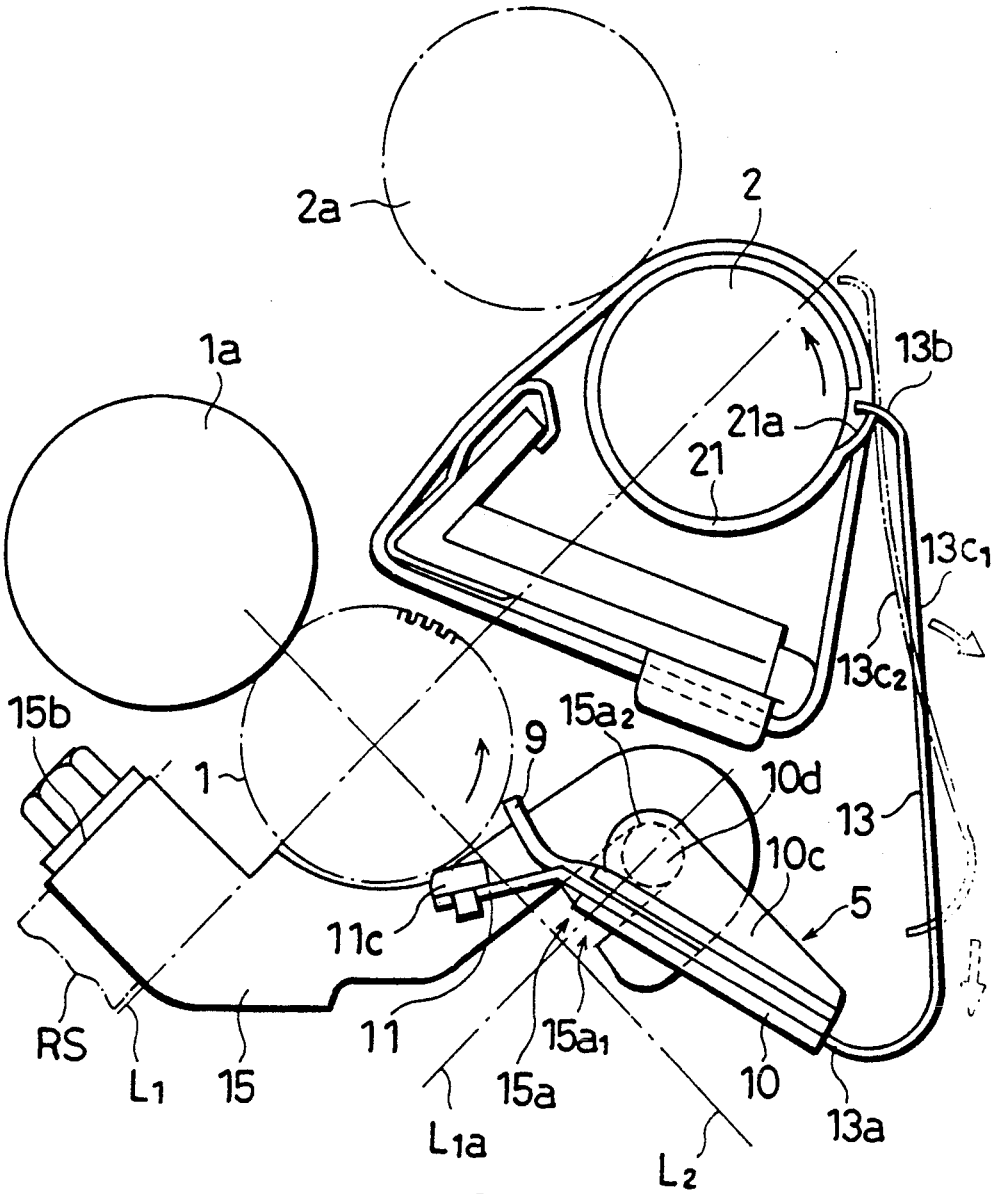
FIG. 6 is a schematic side elevational view showing another preferred embodiment of the present invention.
Figure 7:
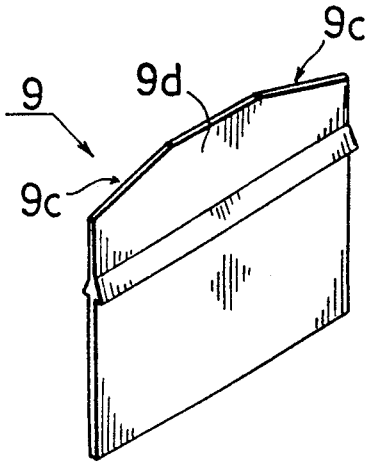
FIG. 7 is a schematic perspective view showing a profile of an alternative clearer pad member for use with a clearer apparatus shown in FIG. 6.

FIG. 6 is a schematic side elevational view showing a clearer apparatus of another embodiment of the present invention. A plurality of clearer pad members 9 mounted on a plate-formed clearer 5 are each formed such that an end portion 9*d* thereof adjacent a draft roller has a reduced width with a pair of recesses 9*c* formed on the opposite side portions of the end thereof as shown in FIG. 7. Meanwhile, an operating elastic plate 13 is formed substantially in an L-shaped profile from a leaf spring made of steel, and a mounting end 13*a*, a repulsive portion $\mathbf{13}_{c1}$ and an arresting projecting end 13*b* are formed in a body on the operating elastic plate 13. The mounting end 13*a* of the operating resilient plate 13 is fixed to the plate-formed clearer 5, and the arresting projected end 13*b* is engaged with and urged by or disengaged from an arresting piece 21*a* of an apron roller 2. In particular, such construction is recommended wherein, when the arresting projected end 13*b* of the operating elastic plate 13 is engaged by the arresting piece 21*a* of the arresting ring 21 and is lifted upwardly to the position indicated by a chain line, the repulsive portion $\mathbf{13}_{c1}$ of the operating resilient plate 13 is curved as indicated by a chain line ($\mathbf{13}_{c2}$) and accordingly is acted upon by such a repulsive force as indicated by a blank arrow mark, and then when the engagement is released, the plate-formed clearer 5 can be pivoted readily as indicated by an arrow mark of a broken line.

A bracket 15 having a most preferable profile is shown in FIG. 6. The bracket 15 has a seat portion 15*b* formed thereon and adapted to be contracted with and mounted on a roller stand RS, and an elongated slot 15*a* is formed in the bracket 15 such that it extends either substantially in parallel to an imaginary axial line $L_1$ (another line $L_{1\,a}$ parallel to this) which passes the centers of the bottom rollers 1 and 2 or a little obliquely such that it is spaced away a little from the draft roller 1 in the direction opposite to the drafting direction. Further, an opening portion $\mathbf{15}_{a1}$ of the elongated slot 15*a* is formed such that it is opposed downwardly on the exit side of the drafting direction while a slot bottom portion $\mathbf{15}_{a2}$ is formed such that it extends deeply to the interior (to the right-hand side in FIG. 6) in the direction opposite to the drafting direction from an imaginary normal line $L_2$ which expends perpendicularly to the axial line $L_1$ and passes the center of the draft roller 1. Accordingly, when the support shafts 10*d* are fitted into the slot bottom portions $\mathbf{15}_{a2}$ of the elongated slots 15*a*, the plate-formed clearer 5 is held in a stable posture on the entering side of draft yarns with respect to the imaginary normal line $L_2$.

It is to be noted that the location of each of the shafts 10*d* of the plate-formed clearer 5 may be an arbitrary position adjacent the draft roller 1 or remote from the draft roller 1 but preferably is a position adjacent the draft roller 1 (on the left side in FIG. 6) such that the clearer pad members 9 may be readily pivoted upwardly around the axis of the support shafts 10*d*.

FIG. 8 is a schematic side elevational view showing a further preferred embodiment of the present invention. In the present embodiment, a shaft 6A provided projectingly on a roller stand RS and a U-shaped bearing 10A provided at an end of a plate-formed clearer 5 are used as pivotally supporting members. In particular, a pair of U-shaped bearings 10A are mounted in a body at the opposite ends of a support frame 10 of a plate-formed clearer 5, and a pair of shafts 6A adapted to be fitted in the bearing 10A are provided projectingly on a pair of opposing roller stands RS such that the plate-formed clearer 5 is supported for pivoting motion on the roller stands RS. It is to be noted that a stopper 11 and an operating elastic plate 13 similar to those of the preceding embodiments described hereinabove are mounted on the support frame 10. Meanwhile, the shafts 6A may otherwise be provided projectingly on a bracket which is mounted on the roller stands RS.

Figure 5:
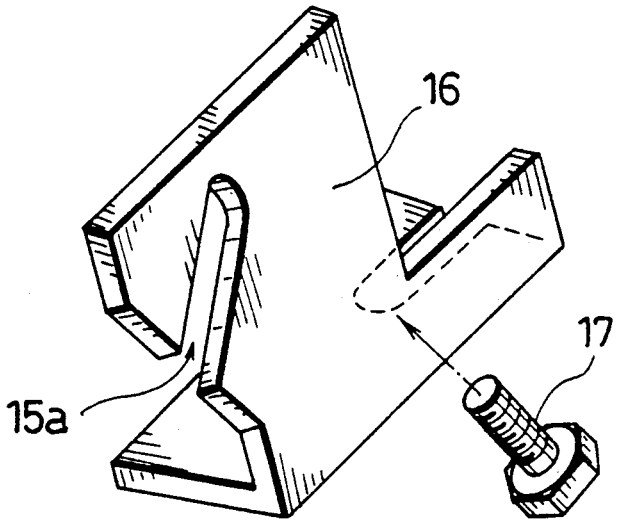
FIG. 5 is a schematic perspective view showing a shape of an alternative bracket for use in an embodiment according to the present invention.

The clearer pad members of the present invention are not limited to those of the embodiments described above, and the projected portion of each of the clearer pad members may have such a profile wherein the cross section thereof decreases toward an end thereof as shown in FIGS. 6 and 7 and an end thereof has a cylindrical cross section. Further, the number of such pad members can be changed arbitrarily and may be made of a synthetic resin material or a soft elastic synthetic resin material such as an urethane resin or the like. Further, the bracket 15 may be mounted directly on an arm of a roller stand as shown in FIG. 5. It is to be noted that, while the bracket 15 is shown having an elongated slot 15*a* formed on only one side of the stand in FIG. 5, such elongated slots may be formed on the opposite sides of the stand such that plate-formed clearers provided on the left and right sides of the stand may be supported in the elongated slots.

Since a clearer apparatus for a draft roller of the present invention has such construction as described above, cotton waste and so forth accumulated on an upper face of a clearer pad member and so forth can be dropped with certainty by intermittently pivoting plate-formed clearer. Further, a support frame of the plate-formed clearer has a structure which can be mounted and removed readily onto and from a bracket which is provided on a roller stand or the like, and further, the plate-formed clearer is held stably at a predetermined position at which it opposes to a draft roller so that cotton waste and so forth on a peripheral face of the draft roller can be brushed away with certainty by the clearer pad member.

What is claimed is:

1. In combination with a draft roller of a drafting apparatus, the draft roller having a peripheral face and the drafting apparatus including an apron roller, the draft roller being rotatable about a fixed axis, a clearer device for clearing waste from said draft roller peripheral face, said clearer device including an elongated support frame, clearer pad means projecting from said support frame, means for mounting said support frame parallel to the draft roller axis with draft roller engageable parts of the clearer pad means in a first mounted upright positioning of the support frame being engaged with the peripheral face of the draft roller at one side of the draft roller axis for brushing waste away from said peripheral face, said mounting means including pivot means connected to said support frame intermediate the ends thereof, an elongated resilient plate, said resilient plate at a first end thereof being connected to said support frame at a lower part of said support frame, an opposite end of said resilient plate being engageable/disengageable with an arresting ring extending from said apron roller so that each time said apron roller rotates, said resilient plate is engaged by said arresting ring and raised causing said support frame to pivot in a predetermined direction to a second mounted position in which it is inclined downwardly and the clearer pad means is moved to a position clear of the draft roller peripheral face with the draft roller engageable parts of said clearer pad means disposed at an opposite side of the draft roller axis and in which second mounted position waste accumulated on said support frame and clearer pad means can drop therefrom, disengagement of the resilient plate opposite end with from said arresting ring causing a repulsive force present in said resilient plate to pivot said support frame in an opposite direction and back to its first mounted position.

2. The combination of claim 1 further comprising a stopper member carried on said support frame and projecting therefrom, said stopper member with said support frame in its first mounted position engaging said draft roller at said opposite side of said draft roller axis to limit the extent to which said support frame can pivot in said opposite pivoting direction.

3. The combination of claim 2 further comprising an abrasion resistant member carried at a tip end of the stopper member engaging the draft roller.

4. The combination of claim 1 in which the resilient plate has a bent profile and is a spring member so that when its opposite end is engaged with the arresting ring, repulsive force is produced therein.

* * * * *